United States Patent [19]

Akashi

[11] 4,377,022

[45] Mar. 22, 1983

[54] SEPARABLE SLIDE FASTENER

[75] Inventor: Shunji Akashi, Kurobe, Japan

[73] Assignee: Yoshida Kogyo K.K., Tokyo, Japan

[21] Appl. No.: 266,482

[22] Filed: May 22, 1981

Related U.S. Application Data

[63] Continuation of Ser. No. 53,081, Jun. 28, 1979, abandoned.

[30] Foreign Application Priority Data

Jul. 12, 1978 [JP] Japan ..... 53-95868[U]

[51] Int. Cl.[3] ..... A44B 19/00

[52] U.S. Cl. ..... 24/205.11 R; 24/205 G; 24/205.11 F

[58] Field of Search ..... 24/205.11 R, 205.11 F, 24/205

[56] References Cited

U.S. PATENT DOCUMENTS

| | | | |
|---|---|---|---|
| 2,502,885 | 4/1950 | Poux | 24/205.11 R |
| 2,506,965 | 5/1960 | Morin | 24/205.11 R |
| 2,526,599 | 10/1950 | Bolten, Jr. | 24/205.11 R |
| 3,162,918 | 12/1964 | Burbank | 24/205.11 F |
| 3,333,305 | 8/1967 | Taylor | 24/205.11 F |
| 3,377,668 | 4/1968 | Carlile et al. | 24/205.11 F |

*Primary Examiner*—Roy D. Frazier
*Assistant Examiner*—Peter A. Aschenbrenner
*Attorney, Agent, or Firm*—Bucknam and Archer

[57] ABSTRACT

A separable slide fastener having a separable assembly comprises a pair of stringer tapes each carrying along one longitudinal edge a row of coupling elements each having a pair of spaced legs and a coupling head extending between the legs. The separable terminal assembly comprises a separable pin and a retainer pin fixed to the bottom end of the respective tapes and a retainer formed integrally with the retainer pin for receiving the separable pin. The rows of coupling elements can be interlocked by interengagement of a pair of lateral projections of the opposed coupling head. The lateral projections of the endmost coupling elements located adjacent to the pins are cut off to permit the endmost coupling elements to be disengaged from each other when the slide fastener is closed.

5 Claims, 1 Drawing Figure

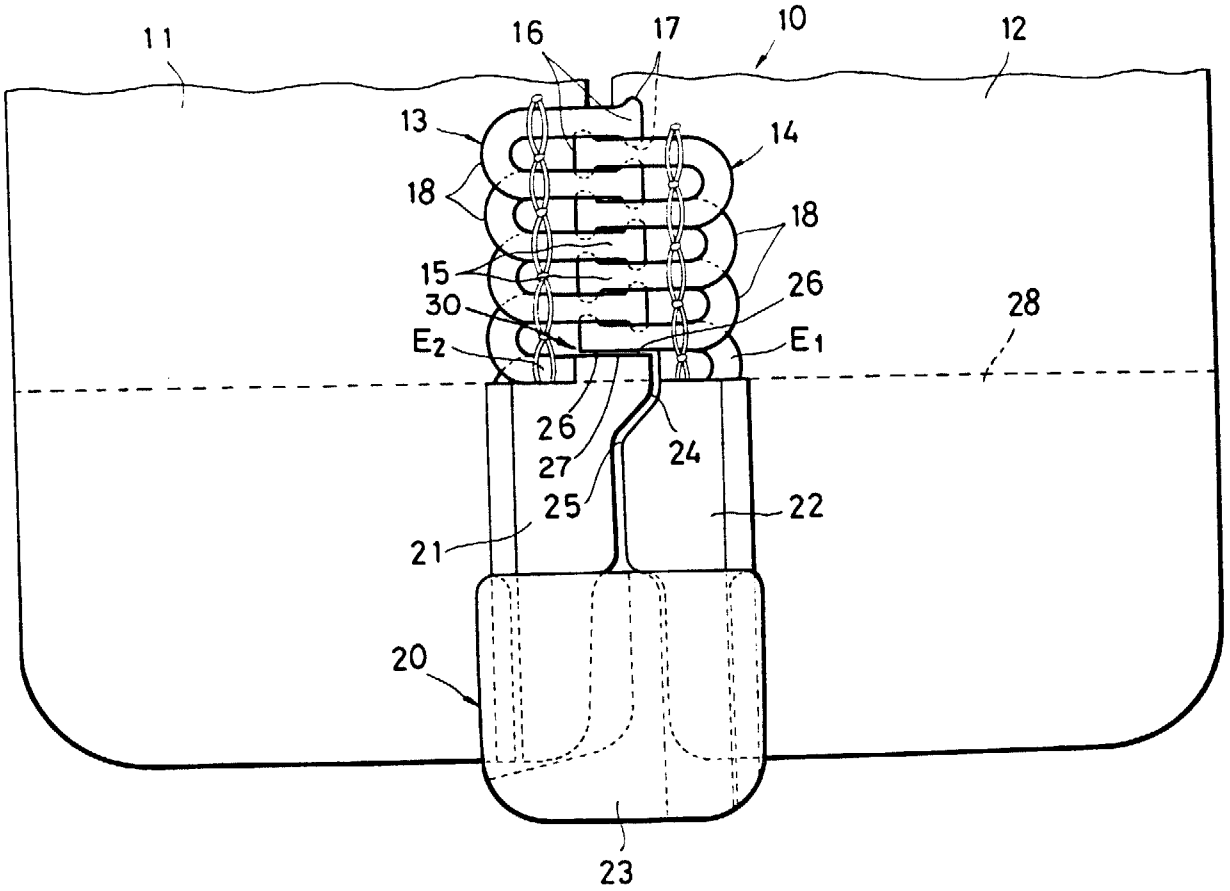
10
11
12
13
14
15
16
17
18
18
20
21
22
23
24
25
26
26
27
28
30
E1
E2

SEPARABLE SLIDE FASTENER

This is a continuation of application Ser. No. 53,081, filed June 28, 1979, now abandoned.

BACKGROUND OF THE INVENTION

1. Field of the Invention

This invention relates to zippers or slide fasteners and more particularly to a separable type of slide fastener having a separable terminal assembly.

2. Prior Art

There have been proposed many separable slide fasteners equipped with a separable terminal assembly which comprises a separable pin fixed to the bottom end of one of companion stringer tapes, a retainer pin fixed to the bottom end of the other stringer tape and a retainer formed integrally with the retainer pin for receiving the separable pin to couple the two stringer tapes. It is a common practice in such slide fasteners to anchor the opposed endmost coupling elements to the separable terminal assembly with a view to preventing the coupling elements from falling off from the stringer tapes.

However, an inevitable disadvantage of such fastener is that the pins of separable terminal assembly respectively fixed to the tapes adjacent to or substantially integral with the endmost coupling elements tend to hinder the smooth engagement or disengagement of the endmost coupling elements, when a slider moves toward and away from the separable terminal assembly to open and close the fastener. In some instances, the slider is blocked at a position just before the separable terminal assembly. The starting movement of the slider in the fastener closing direction is also liable to become sluggish, sometimes even impossible. This problem is aggravated where the separable terminal assembly and the coupling elements are both made of a plastic material, the endmost coupling elements are susceptibly to deformation under heat and pressure applied during fusion of the separable terminal assembly with the endmost coupling elements.

U.S. Pat. No. 3,162,918 discloses a somewhat successful improvement of a separable slide fastener having a row of coupling loops or a coil element which includes a flexible plastic finger integrally molded with a body portion of a separable terminal assembly and extending along the edge of the stringer tape through the coil, the resulting terminal assembly providing secure but relatively flexible connection with the lower portion of the coupling elements. Such arrangement however requires the use of molds precisely finished to fit tightly over the loops of coupling elements and the maintenance of finely controlled molding temperature and pressure conditions, resulting in complicated and costly process and increased consumption of material.

SUMMARY OF THE INVENTION

Accordingly, an object of this invention is to provide a separable slide fastener in which a slider is allowed to move smoothly toward and away from a separable terminal assembly.

Another object of the invention is to provide a separable slide fastener which can be manufactured with maximum ease and minimum cost.

According to the invention, interengaged lateral projections of the coupling heads of opposed endmost coupling elements located adjacent to a pair of pins of a separable terminal assembly are cut off to permit the endmost coupling elements to be disengaged from each other when a separable slide fastener is closed.

The above and other objects, advantages and features of the present invention will become apparent from the following description of a certain preferred embodiment, taken in conjunction with the accompanying drawing.

BRIEF DESCRIPTION OF THE DRAWING

The drawing is an enlarged fragmentary plan view of a separable slide fastener provided in accordance with the invention.

DETAILED DESCRIPTION OF THE PREFERRED EMBODIMENT

There is shown an enlarged fragment of a separable slide fastener generally designated 10 which comprises a pair of stringer tapes 11,12 each carrying on and along its inner longitudinal edge a row of coupling elements 13,14 formed from a continuous plastic filament into a helical coil structure including a plurality of turns spaced longitudinally of the tape. Each of the turns includes a pair of spaced legs 15 and a coupling head 16 extending between the legs 15, the coupling head 16 having a pair of lateral projections 17 extending longitudinally of the row of coupling elements 13,14 beyond the width of the legs 15 so that the rows of coupling elements can be interlocked as the lateral projections of opposed coupling heads are interengaged. Each coupling element 13,14 further has a plurality of connecting portions 18 each extending between adjacent legs 15.

The opposed rows of coupling elements 13,14 are taken into and out of mutual engagement by a slider (not shown) to open and close the fastener 10 in the well known manner.

A separable terminal assembly 20 comprises a separable pin 21 fixed to the bottom end of one end of the stringer tapes 11, a retainer pin 22 fixed to the bottom end of the other stringer tape 12 and a retainer 23 formed integrally with the retainer pin 22 for receiving therein the separable pin 21. The separable pin 21 has a projection 24 along its inner longitudinal edge, the projection 24 extending transversely of the rows of coupling elements 13,14. The retainer pin 22 has a recess 25 receptive of the projection 24.

In accordance with the invention, a pair of endmost coupling elements $E_1$,$E_2$ are fused integrally with the separable terminal assembly 20 in such a manner that the first endmost coupling element $E_1$ is joined at its connecting portion 18 to the upper edge of the retainer pin 22 and the second endmost coupling element $E_2$ is joined at its legs 15 to the upper edge of the separable pin 21. The interengaged lateral projections 17 of the coupling heads 16 of the opposed endmost coupling elements $E_1$,$E_2$ located adjacent to the pins 21,22 are cut off to form flattened coupling surfaces 26, thereby permitting the endmost coupling elements $E_1$,$E_2$ to be disengaged from each other when the separable slide fastener 10 is closed. The legs 15 and the coupling head 16 of the endmost coupling element $E_2$ are partly cut off to form a cut-off flattened surface 17, thereby defining a slot 30 extending transversely of the rows of coupling elements 13,14. The slot 30 preferably has a length greater than the distance between the interengaged coupling heads.

The formation of the separable terminal assembly 20 and the slotted endmost coupling elements $E_1$,$E_2$ just described is accomplished by first placing a strip 28 of thermoplastic material on one surface of the tapes 11,12, the strip 28 overlying a group of the coupling elements 13,14. Then, heat and pressure is applied by a suitable ultrasonic welding or high-frequency heating means (not shown) to the strip 28 for simultaneously fusing the strip 28 with the stringer tapes 11,12 and the group of coupling elements 13,14 and shaping the separable pin 21 and the retainer pin 22 into desired form. Simultaneously with the formation of the pins 21,22, the slot 30 is also formed in the endmost coupling elements $E_1$,$E_2$. The projection 24, recess 25 and slot 30 are formed all simultaneously by a suitable punch (not shown), such that the slot 30 communicates with the recess 25 receiving the projection 24. The box-like retainer 23 is finally joined with the retainer pin 22 by welding or adhesive bonding.

With the separable slide fastener 10 thus constructed, a slider (not shown) is brought against the retainer 23, and the separable pin 21 is inserted through a guide channel in the slider into the retainer 33. When the slider starts in the fastener closing direction from the separable terminal assembly 20, the pair of endmost coupling elements $E_1$,$E_2$ begin to move into mutual engagement with each other. In this instance, the flattened coupling surface 26 of the first endmost coupling element $E_1$ moves clear out of the way of the cut-off flattened surface 27 of the second endmost coupling element $E_2$, so that the slider can continue smooth movement in the fastener closing direction. The slider movement is reversed to effect the opening of the fastener. As the slider moves toward the separable terminal assembly 20, the slot 30 permits the endmost coupling elements $E_1$,$E_2$ to start moving without mutual interference.

Although a preferred embodiment has been shown and described, it should be understood that various changes and modifications can be made therein without departing from the scope of the appended claims.

What is claimed is:

1. A separable slide fastener having a slider adapted to open and close the fastener and comprising a pair of stringer tapes each carrying a row of coupling elements in the form of a continuous, helically coiled filament along one longitudinal edge, each of said coupling elements including a pair of spaced legs supported on one of said tapes, a coupling head extending between said legs and connecting portions extending respectively from said legs remotely from said coupling head and connected to adjacent two of coupling elements, the coupling head of each coupling element having a pair of interengageable lateral projections extending longitudinally of the respective row of coupling elements beyond the width of the respective legs so that the rows of coupling elements can be interlocked in interdigitating relation by said lateral projections, and a separable terminal assembly comprising a separable pin fixed to the bottom end portion of one of said stringer tapes, a retainer pin fixed to the bottom end portion of the other stringer tape and a retainer formed integrally with said retainer pin for receiving therein said separable pin, the coupling heads of said endmost confronting pair of coupling elements having respective confronting flattened surfaces formed by removing said interengageable lateral projections thereof and positioned to allow said pair of coupling elements to have a limited relative movement capability facilitating the opening and closing action of the slider at said separable terminal assembly without mutual interference of said pair of coupling elements, said separable pin and said retainer pin being integral with said endmost coupling elements.

2. A separable slide fastener according to claim 1, wherein the legs and the coupling head of at least one of said endmost confronting pair of coupling elements are configured to define a slot extending transversely of the rows of coupling elements.

3. A separable slide fastener according to claim 1, wherein said slot has a length larger than the interengagement distance of interengaged coupling heads of the fastener.

4. A separable slide fastener according to claim 1, said separable pin having a projection along its inner longitudinal edge, said retainer pin having recess receptive of said projection, said projection extending transversely of the rows of coupling elements, and said slot communicating with said recess.

5. A separable slide fastener according to claim 1, said separable terminal assembly and said coupling element being made of plastic material.

* * * * *